US006694718B2

(12) United States Patent
Humml

(10) Patent No.: US 6,694,718 B2
(45) Date of Patent: Feb. 24, 2004

(54) YARN SPLICING DEVICE

(75) Inventor: Baldur Humml, Erkelenz (DE)

(73) Assignee: W. Schlafhorst AG & Co. (DE)

( * ) Notice: Subject to any disclaimer, the term of this patent is extended or adjusted under 35 U.S.C. 154(b) by 106 days.

(21) Appl. No.: 10/152,758

(22) Filed: May 22, 2002

(65) Prior Publication Data

US 2002/0174643 A1 Nov. 28, 2002

(30) Foreign Application Priority Data

May 22, 2001 (DE) ..... 101 24 832

(51) Int. Cl.[7] ..... B65H 69/06
(52) U.S. Cl. ..... 57/22
(58) Field of Search ..... 57/22, 23, 202; 28/141; 242/475.1, 475.2, 475.3, 475.4, 475.5, 475.6

(56) References Cited

U.S. PATENT DOCUMENTS

| | | | | |
|---|---|---|---|---|
| 4,565,058 A | | 1/1986 | Rohner et al. | 57/22 |
| 4,608,815 A | | 9/1986 | Rohner et al. | 57/22 |
| 5,115,629 A | | 5/1992 | Zumfeld | 57/22 |
| 5,829,706 A | | 11/1998 | Schatton et al. | 242/475.4 |
| 6,434,921 B2 | * | 8/2002 | Premi | 57/23 |

FOREIGN PATENT DOCUMENTS

| | | |
|---|---|---|
| DE | 33 42 858 A1 | 6/1985 |
| DE | 34 08 668 A1 | 9/1985 |
| DE | 40 05 752 A1 | 8/1991 |
| DE | 44 20 979 A1 | 12/1995 |
| DE | 100 60 623 A1 | 6/2001 |

OTHER PUBLICATIONS

German Search Report.

* cited by examiner

*Primary Examiner*—John J. Calvert
*Assistant Examiner*—Shaun R Hurley
(74) *Attorney, Agent, or Firm*—Kennedy Covington Lobdell & Hickman, LLP

(57) ABSTRACT

A yarn splicing device for producing a knot-free yarn connection, particularly with elastic yarns, comprises a splicing body (25) formed with a splicing channel (26) to receive the yarns to be spliced and having at least one compressed air inlet opening (29) for pneumatic splicing of their constituent fibers. Yarn clamping devices (43, 44) and cutting devices (41, 42) are provided adjacent the splicing channel. Preparatory nozzles (53, 54) act to prepare the yarn ends for splicing and pneumatically hold the yarn ends to be spliced. Restraining devices (49; 50) are arranged along the splicing extent of the yarn between the clamping devices (43; 44) and the preparatory nozzles (53; 54) to pneumatically resist contraction of the yarn ends up to the preparatory nozzle (53; 54). The number of unsuccessful yarn splicing attempts with elastic yarns thereby can be reduced.

9 Claims, 5 Drawing Sheets

YARN SPLICING DEVICE

CROSS-REFERENCES TO RELATED APPLICATIONS

This application claims the benefit of German patent application DE P 10124832.6 filed May 22, 2001, herein incorporated by reference.

FIELD OF THE INVENTION

The present invention relates to a yarn splicing device for producing a knot-free yarn connection in a spicing channel of a splicing body and, more particularly, to a splicing device adapted for splicing an elastic yarn.

BACKGROUND OF THE INVENTION

Such yarn splicing devices commonly comprise a splicing body formed with a splicing channel for receiving an upper yarn and a lower yarn to be spliced with one another and at least one inlet opening into the splicing channel for injecting compressed air thereinto for pneumatically splicing constituent fibers of the yarns. Respective clamping devices clamp the upper yarn adjacent one end of the splicing channel and the lower yarn adjacent an opposite end of the splicing channel. Likewise, respective cutting devices cut an end of the upper yarn to a defined length adjacent the opposite end of the splicing channel and cut an end of the lower yarn to a defined length adjacent the one end of the splicing channel. A preparatory nozzle adjacent the upper yarn cutting device prepares the end of the upper yarn for splicing and pneumatically holds the upper yarn end while being prepared, and a like preparatory nozzle adjacent the lower yarn cutting device prepares the end of the lower yarn while pneumatically holding it.

Such yarn splicing devices are described, e.g., in German Patent Publication DE 40 05 752 A1 or DE 44 20 979 A1. The attempt is being made to adapt pneumatic yarn splicing devices to a growing range of threads and yarns in order to be able to produce knot-free connections with great tensile strength and a good appearance for all applications. These yarn connections should differ as little as possible from the tensile strength and the appearance of the main length of the thread or yarn. The pneumatic splicing is carried out in a splicing channel or conduit. The yarns to be connected are placed into this splicing channel in opposite directions and in an overlapping manner. The yarn ends are subjected in preparatory nozzles, also called opening tubes, to a suitable pneumatic or pneumatic/mechanical pre-treatment for the opening and parallelization of their constituent fibers. The yarn ends are subsequently intermingled in the splicing channel of a splicing body, that is designated in German Patent Publication DE 44 20 979 A1 as a splicing head, with the aid of compressed air to a knot-free yarn connection. Such a splicing can achieve approximately the same yarn strength as the main length of the yarn and represents an almost yarn-like connection of two yarn ends. The time of the actual splicing process is usually approximately 15 to 40 ms, depending on the particular splicing conditions.

Presently, elastic and highly elastic yarns, e.g., for socks, underwear and sports clothing, are being processed to a great extent. These yarns frequently comprise a highly elastic core yarn whose material consists, for example, of spandex fiber. Elastic and highly elastic yarns can cause significant problems during the splicing process. Defective splices or even no splice connection frequently occur. The cause of this resides in the elastic behavior of the yarn in the yarn splicing device.

After a yarn break the so-called upper yarn is grasped by a pivotable suction nozzle and placed into the yarn splicing device in a tensioned state by pivoting the suction nozzle. The same process is used with the so-called lower yarn. Both the upper yarn and the lower yarn are clamped under tension in a clamping device and their ends are severed by a cutting device. In order to draw the yarn ends into the adjacent preparatory nozzles by suction immediately after the cutting and to hold them there until the actual splicing process, compressed air is usually blown into the preparatory nozzles before the cutting action, which air is directed away from the mouth of the preparatory nozzles onto the yarn end and produces a suction action. In the case of elastic and highly elastic yarns, the contractive relaxation of the elastic yarn end when freed by the yarn cutting action is so great that the yarn ends are no longer held by the suction draw in the preparatory nozzles and may possibly even be drawn entirely out of the preparatory nozzles. This hinders or prevents the preparatory opening of the yarn ends as well as the subsequent splicing process. Unsuccessful splicing attempts and therewith repetitions of the entire yarn connecting process occur. The suction action exerted by the preparatory nozzles can not be reinforced as desired in order to increase the holding power since this, on the one hand, causes a greater consumption of compressed air, which is undesired for economic reasons, and on the other hand, can result in an adverse effect on the quality of the splice. As is known, a substantially more protective, better and more uniform opening of the yarn ends takes place at rather low pressures of the preparatory air.

The described deficiencies can not be eliminated with the known yarn splicing devices existing in accordance with the present state of the art.

SUMMARY OF THE INVENTION

Thus, the present invention seeks to address the problem of improving the known yarn splicing devices to enable them to reliably splice elastic yarns.

The present invention addresses this problem by providing a yarn splicing device of the type described above with restraining devices arranged between each yarn clamping device and its associated yarn preparatory nozzle for pneumatically retarding the contraction of elastic yarn ends up to the yarn preparatory nozzles after cutting of the yarn ends.

In this manner, the contraction of the elastic yarn ends is sufficiently reduced and the withdrawal of the yarn ends from the preparatory nozzles is successfully counteracted by the restraining devices acting pneumatically on the yarn between the clamping devices and the preparatory nozzles. The preparation of the yarn ends for splicing and the splicing process itself are no longer disturbed or prevented by the yarn contraction. Standstill times caused by repetitions of the splicing process are avoided. Bulky, additional mechanical clamping devices in the area of the splicing body are not necessary. The action of the restraining device begins extremely rapidly upon actuation. Standard yarn consisting of different raw materials that are wound instead of elastic yarns on a work site in accordance with the invention can be processed without disadvantage as regards the yarn joining process or the quality of the yarn connection.

The restraining devices are preferably arranged between the splicing body and the preparatory nozzle. Compared with an alternative design in which the restraining device is arranged between the splicing body and the clamping device, thus creating more space for the restraining device, there is less play available given the selection of the position of the restraining device, but the contraction of the stretched yarn can be shortened to an especially great extent.

The restraining device is preferably designed as a suction nozzle comprising elements that prevent the drawing in by suction of the yarn end. This reliably avoids the situation that the yarn end can be drawn out of the preparatory nozzle by the drawing in by suction of the yarn end into the restraining device. This can be brought about in an advantageous manner by a tubular suction nozzle with an air-permeable cover on the suction intake. A design of the cover as a grate with grate rods running largely transversely to the path of the yarn, together with the tensioning of the yarn caused by the preparatory nozzle, prevents the drawing in of the yarn into the restraining device and acts preventively against a clogging of the cover, as can readily occur with a wire mesh. If the control device associated with the yarn splicing device is set up in such a manner that it continuously activates the restraining device at the latest during the cutting of the yarn and up to actuation of the splicing device, a reliable course of the splicing process is assured.

If the preparatory nozzle and the restraining device are connected at the same time to a source of compressed air, the control expense is especially low since no switching times that differ from one another must be observed. The loading of the preparatory nozzles and of the restraining device with compressed air for the injection of air and to produce the particular suction effect can take place with a single, joint switching process. The preparatory nozzle and the restraining device can be connected to the same source of compressed air, which permits an especially simple construction as regards compressed-air lines and switching elements. Alternatively, the preparatory nozzle and the restraining device can be connected to two sources of compressed air with different strengths, which makes a controlling of the holding power of the restraining device readily possible. In another alternative embodiment the restraining device can be connected to a vacuum source in order to produce the suction action.

A friction surface is advantageously arranged adjacent to the restraining device in such a manner that the yarn rests on the friction surface when the restraining device is actuated. This supports and increases the restraining action on the yarn without any damage being caused to the yarn.

The yarn splicing device in accordance with the present invention can also be used in open-end spinning machines. As is known, it is also customary in such textile machines to prepare the yarn end in an appropriate preparatory nozzle before the new spinning start.

The invention permits the desired quality of the splice to be observed and the number of unsuccessful splicing attempts to be lowered. This achieves an increase in the yarn quality and in the productivity of the winding head and of the entire textile machine.

The present invention will be further explained in detail with reference to exemplary embodiments shown in the accompanying drawing figures.

DESCRIPTION OF THE PREFERRED EMBODIMENTS

Figure 1:
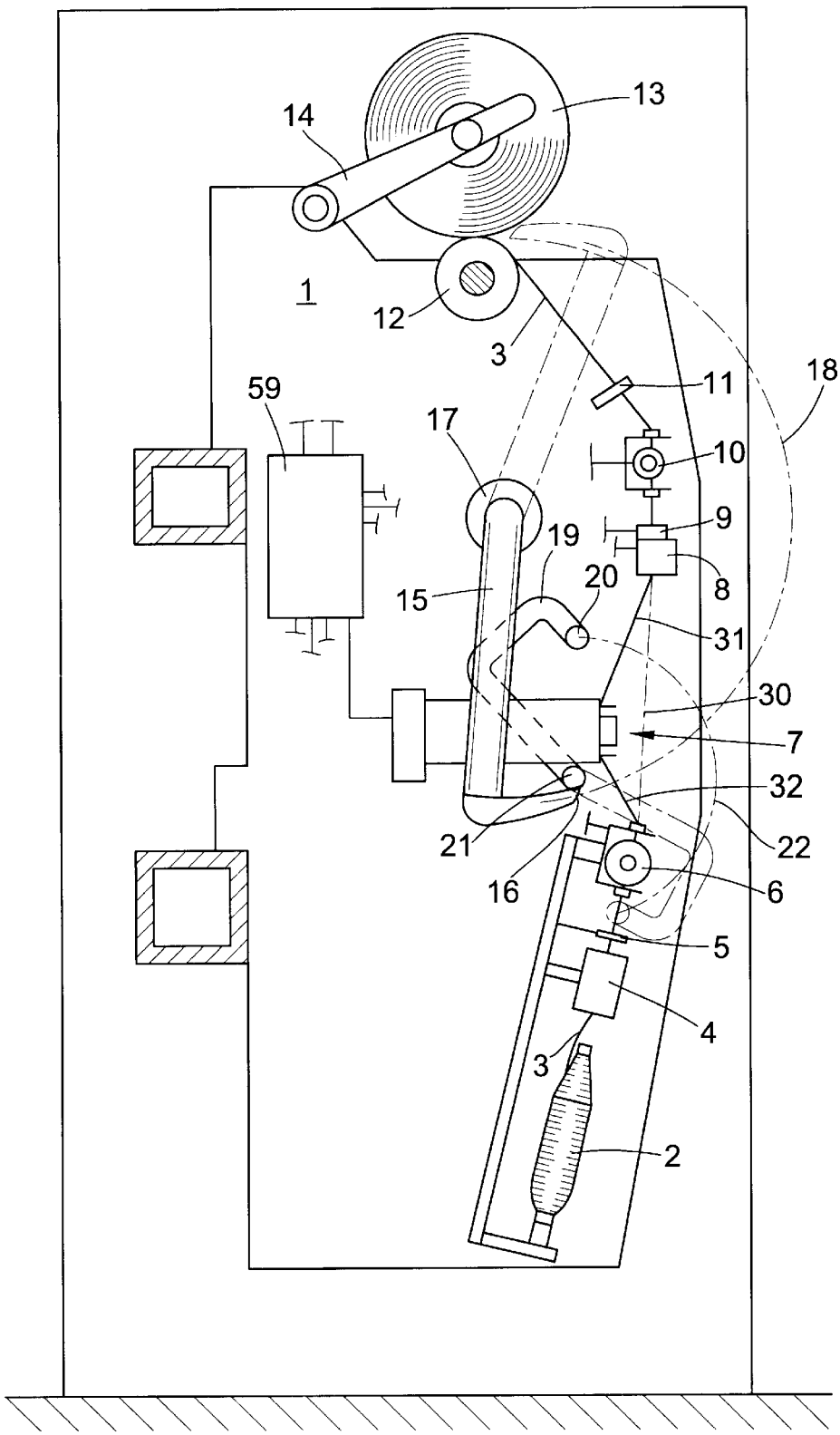
FIG. 1 is a schematic side elevational view of a winding head of a cheese-producing bobbin winding machine with a pneumatic yarn splicing device in accordance with the present invention.

Referring now to the accompanying drawings and initially to FIG. 1, a winding head 1 is schematically shown as part of a textile machine for producing cheeses. Such textile machines, also called cheese winders, comprise a plurality of such winding heads arranged adjacently to one another. The design and operation of such winding heads are already known to those persons skilled in the art, so that only a summary description thereof is believed to be necessary.

A yarn 3 is drawn off from unwinding bobbin 2 and guided over balloon breaker 4 and yarn eyelet 5 to yarn tensioner 6. Yarn splicing device 7 is arranged between yarn tensioner 6 and cleaner 8. During the normal yarn winding process, yarn 3 assumes the path of travel designated by reference numeral 30. Yarn scissors 9 are associated with cleaner 8 which interrupts the yarn travel and actuates severing of the yarn 3 when cleaner 8 determines an inadmissible deviation from given quality values of yarn 3. After yarn scissors 9, yarn 3 travels through paraffin waxing device 10 and over guide element 11 onto grooved drum 12 that drives a cheese 13 and at the same time effects the winding of yarn 3 thereon in a cross winding form. Cheese 13 is carried in cheese holder 14.

In the exemplary embodiment of FIG. 1, the course of the yarn travel between unwinding bobbin 2 and cheese 13 is shown to be interrupted. Such an interruption of the travel of the yarn occurs if the yarn is torn (a so-called yarn break) or has been cut by yarn scissors 9. Further interruptions of the course of the yarn travel can occur due to a change of unwinding bobbin or when the cheese has attained its pre-set diameter.

The connecting of the yarn ends of upper yarn 31 running to cheese 13 and of lower yarn 32 drawn off from unwinding bobbin 2 takes place in yarn splicing device 7. In order not to disturb the travel of the yarn during normal winding operation, yarn splicing device 7 is set back from travel path 30 of yarn 3. Thus, in order to make a yarn connection, the yarn ends must be placed into yarn splicing device 7. Pivoting nozzle 15 with suction slot 16 is provided for inserting upper yarn 31 into yarn splicing device 7. In order to grasp the yarn end of upper yarn 31, pivoting nozzle 15 pivots about its rotary articulation 17 into the position shown in dotted lines. The end of upper yarn 31 trailing from the cheese 13 is drawn by suction through suction slot 16 from the surface of cheese 13, which is driven during the grasping process counter to the normal direction of rotation during yarn winding. Then, pivoting nozzle 15 pivots back into the initial position. The suctioned end of upper yarn 31 is guided thereby in circular arc 18 and placed into guide element 11, paraffin waxing device 10, yarn scissors 9, yarn cleaner 8 and also yarn splicing device 7. Lower yarn 32 is similarly grasped by suction tube 19 below yarn tensioner 6. To this end, suction tube 19 pivots out of its resting position about its rotary articulation 21 into the position indicated in dotted lines. Suction intake opening 20 stands after this pivoting procedure in the dotted-line position in front of yarn 3 and draws it out of opening yarn tensioner 6. Then suction tube 19 pivots about rotary articulation 21 in circular arc 22 back into its resting position. Lower yarn 32 is placed thereby into open yarn tensioner 6 and into yarn splicing device 7. The control of these motions of the pivoting nozzle 15 and suction tube 19 takes place by means of control device 59.

Figure 2:
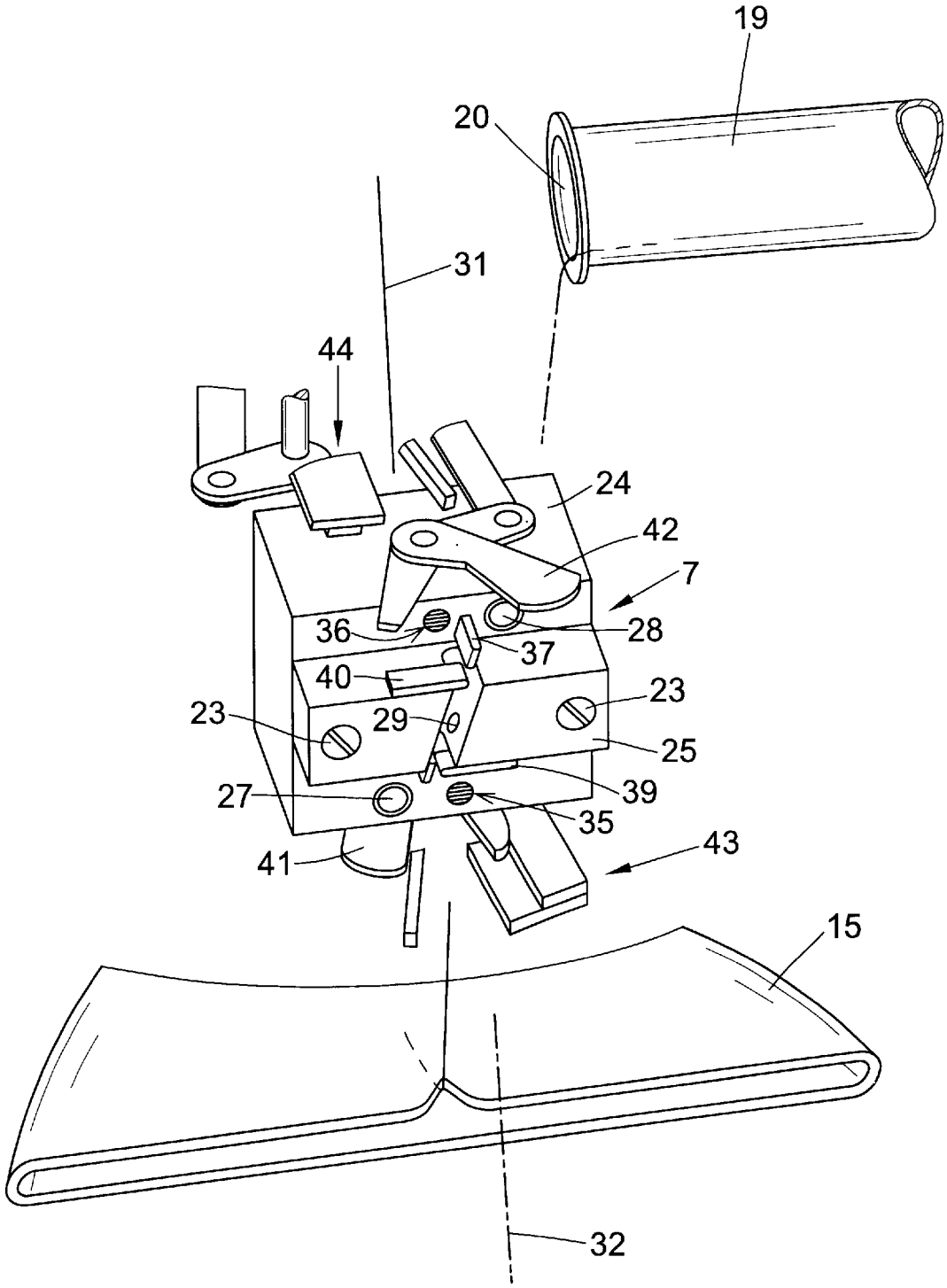
FIG. 2 is a simplified perspective view of the yarn splicing device of the present invention.

FIG. 2 shows the construction of yarn splicing device 7 of the invention in perspective. Yarn splicing device 7 comprises splicing body 25 fastened by screws 23 on air distributor block 24. The splicing body 25 is formed with splicing channel 26. The splicing device further comprises preparatory nozzles 27, 28 arranged above and below splicing body 25 in air distributor block 24. Inlet openings 29 for compressed air empty into splicing channel 26. Yarn baffles 39, 49 are arranged adjacent to splicing channel 26 to support the insertion of the yarn ends into yarn splicing device 7 by pivot nozzle 15 and suction tube 19. The entry area of preparatory nozzles 27, 28 is arranged in the immediate vicinity of cutting devices 41, 42. Yarn clamping devices 43, 44 are disposed adjacent to cutting devices 41, 42. The course of the yarn travel is only partially indicated in FIG. 2.

Figure 3:
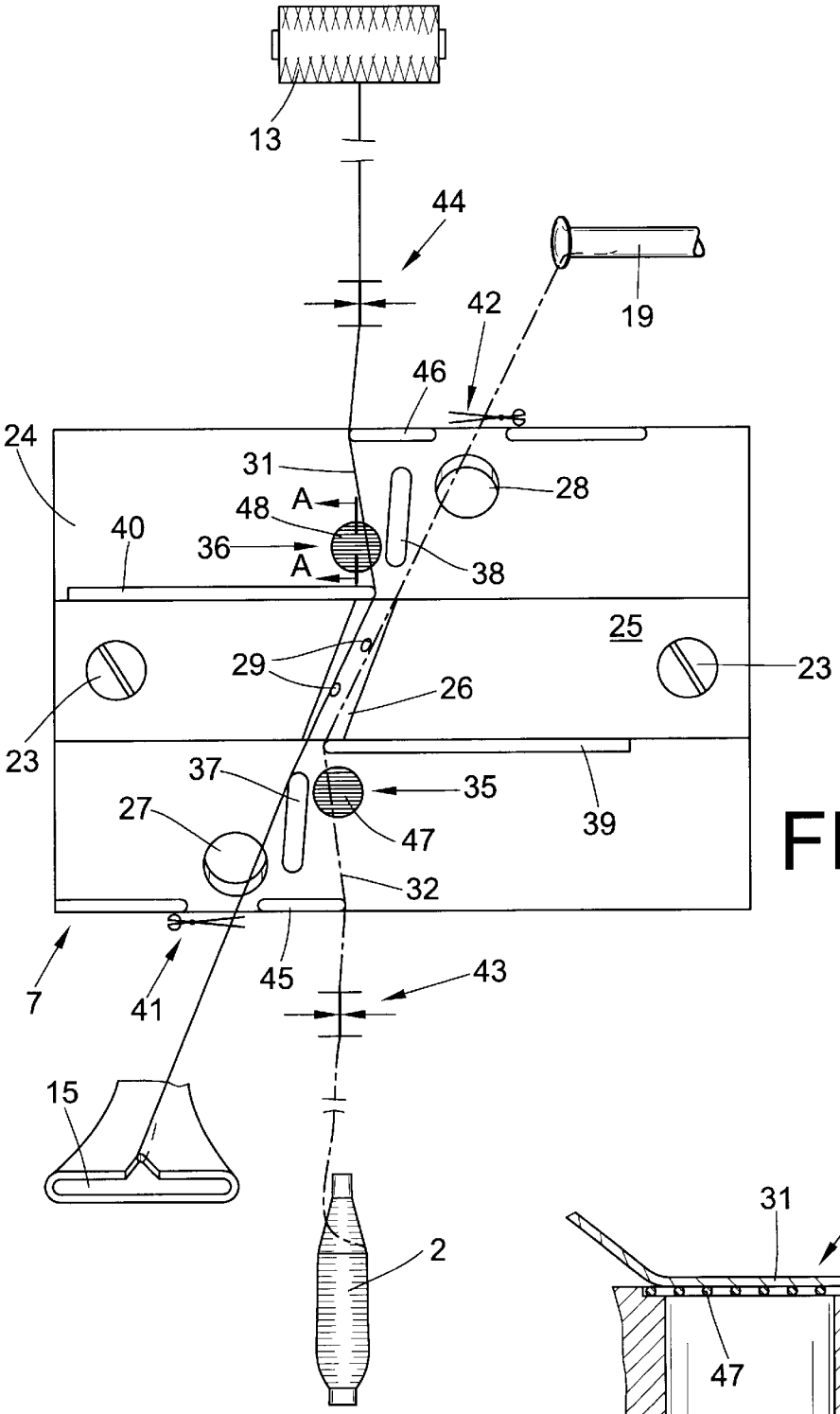
FIGS. 3 and 5 are simplified front elevational views of the same embodiment of the yarn splicing device as FIG. 2, showing different phases of the yarn-end preparation.
Figure 4:
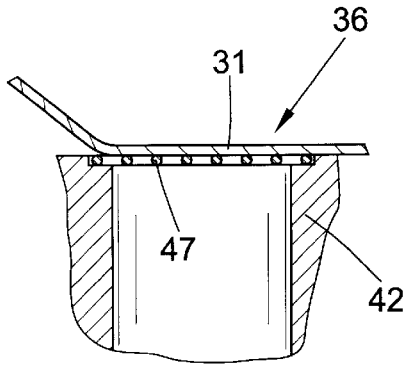
FIG. 4 is a cross-sectional view of the yarn splicing device of FIG. 2, taken through the restraining device thereof along section line A—A of FIG. 3.
Figure 5:
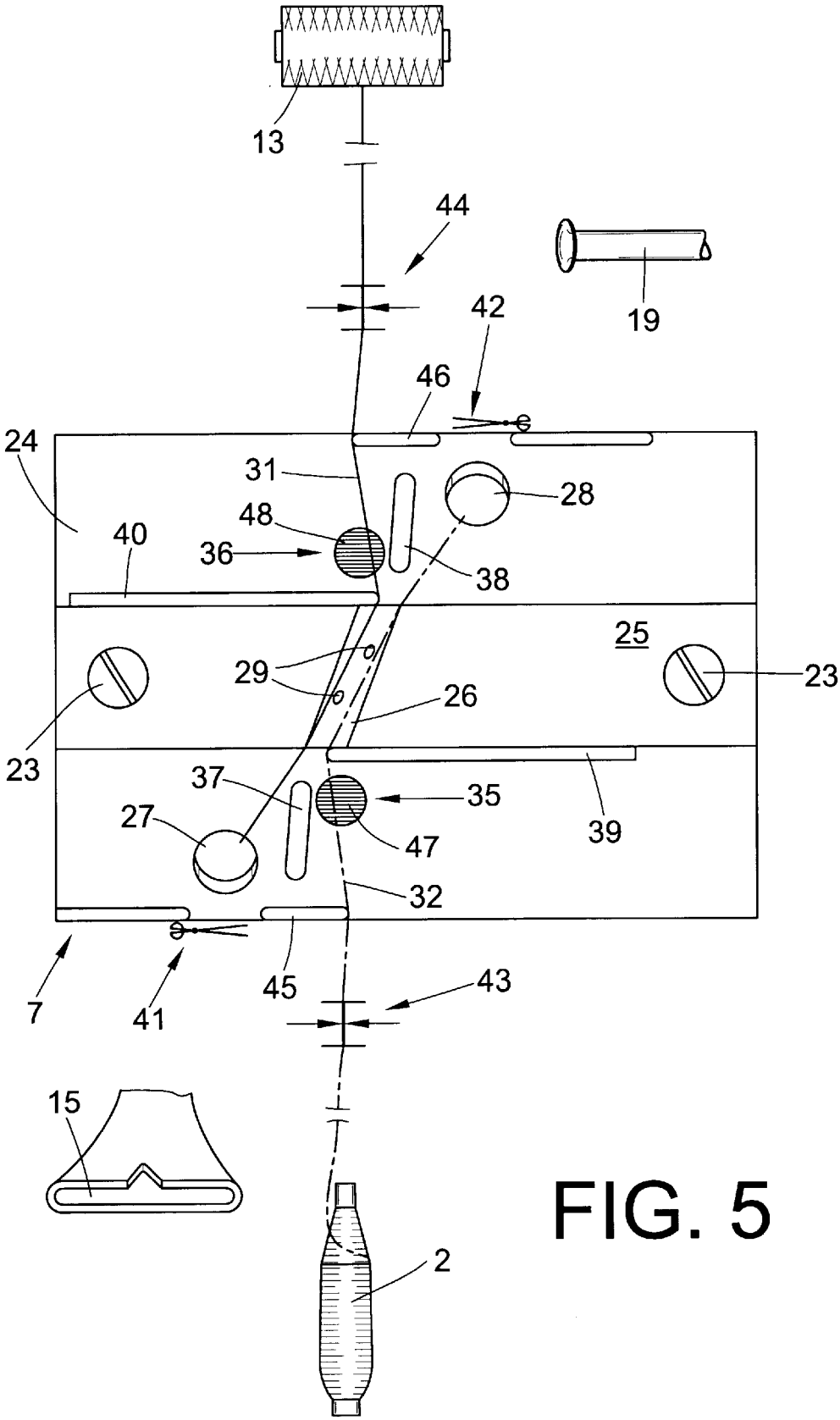

The operation of the yarn splicing device in accordance with the present invention is explained below with reference to FIGS. 3 to 7. In the view of FIG. 3, the yarn ends have already been inserted into channel 26 of splicing device 7 but have not yet been prepared and also not yet cut. Pivot nozzle 15 has received upper yarn 31 on the surface of cheese 13 with its suction slot 16 and has pivoted with upper yarn 31 into the lower position shown. Suction slot 16 has moved during this pivoting motion on circular arc 18 indicated in FIG. 1, during which upper yarn 31, guided by yarn baffles 40, 46, has been placed into upper yarn clamping device 44, which at this stage is open, into splicing channel 26, and also into the lower yarn cutting device 41, which also is open at this stage.

Lower yarn 32 drawn off from unwinding bobbin 2 has been correspondingly placed by suction intake opening 20 pivoting upward on circular arc 22 indicated in FIG. 1 into opened lower clamping device 43, into splicing channel 26 and into opened upper cutting device 42, during which upper yarn 31 has been guided by yarn baffles 39.

Thereafter, the clamping devices 43, 44 are closed, whereupon upper yarn 31 and lower yarn 32 assume the path shown in FIG. 3 in which the yarns at least partially traverse the mouths of preparatory nozzles 27, 28 and of restraining devices 35, 36 and are held thereby under the suction action generated by the blowing in of compressed air into preparatory nozzles 27, 28 and restraining devices 35, 36.

Lower yarn 32 held fast in lower clamping device 43 is subsequently cut by actuating cutting device 42. The yarn remnant is removed by suction tube 19. Upper yarn held fast in upper clamping device 44 is also cut in a corresponding manner by cutting device 41. The holding action of pivot nozzle 15 and of suction tube 19 is cancelled by the cutting. Since preparatory nozzles 27, 28 are already loaded with compressed air at the time of the actuating of cutting devices 41, 42, the yarn ends are immediately drawn into preparatory nozzles 27, 28 and assume the position shown in FIG. 5.

Restraining devices 35, 36 are designed as suction nozzles and are covered with grates 47, 48 so that upper yarn 31 and lower yarn 32 can not be drawn by suction into restraining devices 35, 36. Restraining devices 35, 36 are connected simultaneously with preparatory nozzles 27, 28 to a source of compressed air, not shown for reasons of simplicity. Upper yarn 31 and lower yarn 32 are drawn by the blowing in of compressed air and the suction action produced thereby and are pressed against the grate rods of grate 47, 48 as can be seen from FIG. 4. This pressure force effects a restraining of the elastic yarn ends and thus counteracts and retards their tendency to contract from the previously stretched condition of the yarns, whereby the length by which the yarn ends held by clamping devices 43, 44 can be reduced.

Separating tab 37 shields lower yarn 32 from the flow of intake air of preparatory nozzle 27 and screens upper yarn 31 from the flow of intake air of restraining device 35 and in this manner prevents an undesired influencing of the yarn position. In a corresponding manner, separating tab 38 shields upper yarn 31 from preparatory nozzle 28 and shields lower yarn 32 from restraining device 36. The grate rods of grate 47 and or grate 48 run largely transversely to the course of the yarn of upper yarn 31 and lower yarn 32. This arrangement deters upper yarn 31 and lower yarn 32 from being drawn into the associated restraining devices 35, 36.

The preparation of the yarn ends of upper yarn 31 and lower yarn 32 for the splicing operation and the ensuing course of the splicing operation takes place in a known manner. Further explanations for the yarn joining process can be gathered, e.g., from German Patent Publications DE 40 05 752 A1 or DE 44 20 979 A1, or their corresponding U.S. Pat. Nos. 5,115,629 and 5,829,706, which are incorporated herein by reference.

Figure 6:
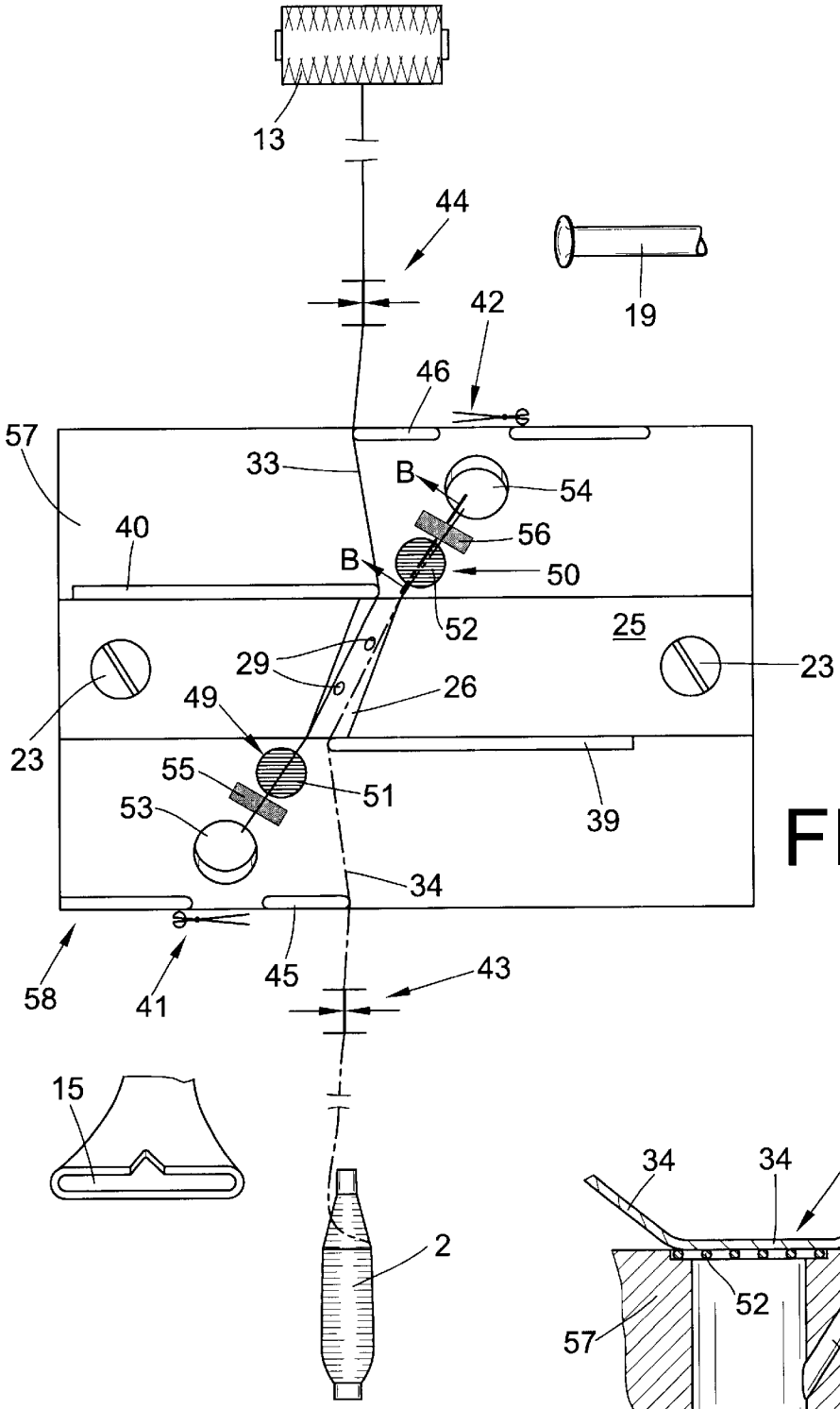
FIG. 6 is another simplified front elevational view of another embodiment of the yarn splicing device of the present invention, shown in a phase of the yarn-end preparation.

FIG. 6 shows an alternative design of the subject matter of the present invention. Yarn splicing device 58 comprises air distributor block 57 to which splicing body 25 with splicing channel 26 is fastened by screws 23. Restraining device 49 and associated preparatory nozzle 53 for upper yarn 33 are located on the same side of splicing body 25 and likewise restraining device 50 and associated preparatory nozzle 54 for lower yarn 34 are located on the same side of splicing body 25. The contraction of the stretching of upper yarn 33 and lower yarn 34 is minimized by this arrangement. Grates 51, 52 cover the respective suction intakes of restraining devices 49, 50 and prevent a drawing in of the yarn ends of a yarn loop into the suction intakes of restraining devices 49 or 50. Even in the embodiment in accordance with FIG. 6, the rods of grates 51, 52 advantageously run transversely to the direction of travel of upper yarn 33 and of lower yarn 34.

Figure 7:
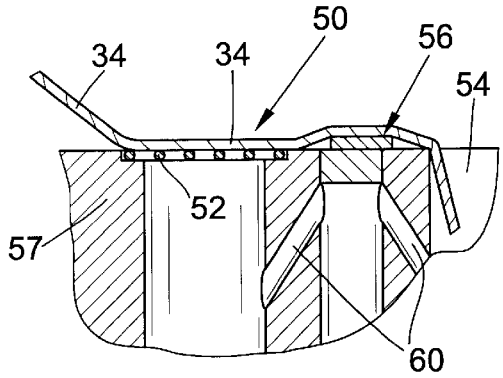
FIG. 7 is a cross-sectional view of the yarn splicing device of FIG. 6, taken through the restraining device thereof along section line B—B thereof.

During the severing of lower yarn 34 by cutting device 42, the preparatory nozzle 54 and restraining device 50 are connected to a source of compressed air (not shown for reasons of simplicity). The compressed air is blown into preparatory nozzle 54 and restraining device 50 by air nozzles 60. After the separation the tensioned, elastic lower yarn 34 would otherwise contract without restraining device 50 and possibly be drawn out of preparatory nozzle 54 or even out of splicing channel 26. However, the end of lower yarn 34 is held fast by restraining device 50 acting pneumatically on lower yarn 34. The holding action of restraining device 50 is reinforced by friction surface 56. Due to the suction action of preparatory nozzle 54 and of restraining device 50, lower yarn 34 rests on friction surface 56, as shown in FIG. 7, and the friction becomes active in an advantageous manner. If restraining device 50 is no longer loaded with compressed air, lower yarn 34 rises off of friction surface 56 again on account of the yarn tension. A corresponding effect occurs with respect to upper yarn 33, via the coordinated actions of cutting device 41, preparatory nozzle 53, restraining device 49 and friction surface 55.

The invention is naturally not limited to the exemplary embodiments shown in FIGS. 1 to 7. Alternatively, for example, in another embodiment (not shown) restraining device 35, 36, 49, 50 can be connected to a vacuum source and the suction action generated by loading with vacuum.

Further information about the drive, support and mounting of device parts as well as the control and linkage can be gathered, to the extent not explained in detail here, e.g., from the cited publications, which are incorporated herein by reference, and the known state of the art cited therein.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A yarn splicing device for producing a knot-free yarn connection in an elastic yarn, comprising a splicing body formed with a splicing channel for receiving an upper yarn and a lower yarn to be spliced with one another, at least one inlet opening into the splicing channel for injecting compressed air thereinto for pneumatically splicing constituent fibers of the yarns, a clamping device for clamping the upper yarn adjacent one end of the splicing channel, a clamping device for clamping the lower yarn adjacent an opposite end of the splicing channel, a cutting device for cutting an end of the upper yarn to a defined length adjacent the opposite end of the splicing channel, a cutting device for cutting an end of the lower yarn to a defined length adjacent the one end of the splicing channel, a preparatory nozzle adjacent the upper yarn cutting device for preparing the end of the upper yarn and for pneumatically holding the upper yarn end while being prepared, a preparatory nozzle adjacent the lower yarn cutting device for preparing the end of the lower yarn and for pneumatically holding the lower yarn end while being prepared, a restraining device arranged between the upper yarn clamping device and the upper yarn preparatory nozzle for pneumatically retarding contraction of the upper yarn end up to the upper yarn preparatory nozzle after cutting of the upper yarn end, and a restraining device arranged between the lower yarn clamping device and the lower yarn preparatory nozzle for pneumatically retarding contraction of the lower yarn end up to the lower yarn preparatory nozzle after cutting of the lower yarn end.

2. The yarn splicing device according to claim 1, characterized in that each restraining device is arranged between the splicing body and the preparatory nozzle respectively associated with the restraining device.

3. The yarn splicing device according to claim 1, characterized in that each restraining device is arranged between the splicing body and the clamping device respectively associated with the restraining device.

4. The yarn splicing device according to claim 1, characterized in that each restraining device comprises a suction nozzle and elements for preventing the drawing of yarn thereinto by suction.

5. The yarn splicing device according to claim 4, characterized in that the suction nozzle is tubular and that the elements comprise an air-permeable cover.

6. The yarn splicing device according to claim 5, characterized in that the cover is comprises a grate having grate rods extending essentially transversely to a splicing extent of the yarn.

7. The yarn splicing device according to claim 1, characterized further by an associated control device arranged to activate each restraining device between a cutting of the yarns and a splicing of the yarns.

8. The yarn splicing device according to claim 7, characterized in that the preparatory nozzles and the restraining devices are connected simultaneously to a common source of compressed air.

9. The yarn splicing device according to claim 1, characterized further by a friction surface arranged adjacent to each restraining device for resting thereon of one of the yarn ends when the restraining devices are actuated.

* * * * *